US012305946B1

(12) United States Patent
Withey

(10) Patent No.: US 12,305,946 B1
(45) Date of Patent: May 20, 2025

(54) TOOL-LESS TAKEDOWN ROD FOR PISTOL

(71) Applicant: Kimber IP, LLC, Troy, AL (US)

(72) Inventor: Michael Withey, Brundidge, AL (US)

(73) Assignee: Kimber IP, LLC, Troy, AL (US)

( * ) Notice: Subject to any disclaimer, the term of this patent is extended or adjusted under 35 U.S.C. 154(b) by 0 days.

(21) Appl. No.: 18/432,951

(22) Filed: Feb. 5, 2024

(51) Int. Cl.
*F41A 3/86* (2006.01)
*F41A 21/48* (2006.01)
*F41A 25/12* (2006.01)

(52) U.S. Cl.
CPC ..... *F41A 3/86* (2013.01); *F41A 21/488* (2013.01)

(58) Field of Classification Search
CPC ..... F41A 3/86; F41A 25/12; F41A 21/26
See application file for complete search history.

(56) References Cited

U.S. PATENT DOCUMENTS 984,519 A 2/1911 Browning
1,563,675 A * 12/1925 Tansley ..... F41A 17/38 89/196
4,972,760 A * 11/1990 McDonnell ..... F41A 3/80 89/196
8,539,706 B1 * 9/2013 Vieweg ..... F41A 3/82 42/1.06
8,640,375 B2 * 2/2014 Ketchum ..... F41A 11/00 42/108
11,530,887 B2 * 12/2022 Mooney ..... F41A 25/12
12,181,241 B2 * 12/2024 Dawson, Jr. ..... F41A 21/36
2022/0196352 A1 * 6/2022 Mooney ..... F41A 25/12
2023/0175797 A1 * 6/2023 Dawson, Jr. ..... F41A 21/36 89/199

* cited by examiner

*Primary Examiner* — Derrick R Morgan
(74) *Attorney, Agent, or Firm* — Kaplan Breyer Schwarz, LLP

(57) ABSTRACT

A recoil rod assembly is provided, including a front rod and a rear rod. A cylindrical protuberance is disposed at the rear end of the front rod or the front end of the rear rod. A cylindrical aperture is disposed at the other. The axis of the cylindrical protuberance or the axis of the cylindrical aperture is offset from the axis of the rear rod. The cylindrical protuberance is disposed in the cylindrical aperture, wherein the axis of the cylindrical protuberance and the axis of the cylindrical aperture are coaxial. The front rod is rotatable with respect to the rear rod about the coaxial axes from a first position wherein the axis of the front rod is coaxial with the axis of the rear rod to a second position wherein the axis of the front rod is offset from the axis of the rear rod.

16 Claims, 18 Drawing Sheets

TOOL-LESS TAKEDOWN ROD FOR PISTOL

BACKGROUND OF THE INVENTION

The present invention relates to handgun disassembly. More particularly, the present invention relates to an improved disassembly device for a handgun.

The M1911-style handgun was initially developed and commercialized by John Browning more than 100 years ago, in 1911, and patented as U.S. Pat. No. 984,519 (Browning). This handgun employed a then-novel mechanism for firing in a semiautomatic fashion substantially large cartridges of .45 caliber, for example .45 ACP (Automatic Colt Pistol) cartridges. This handgun is sometimes referenced as the Government Model 1911 and was for many years favored for use in the U.S. military and served as a hand weapon for U.S. soldiers in the World Wars. This weapon is still favored for personal defense, because it is capable of shooting a relatively large caliber bullet which has substantial "stopping power" when used against animals or humans.

Routine maintenance of the handgun is a considerable factor in contributing to ease of ownership and handgun safety. Accordingly, the periodic cleaning of the handgun is an absolute necessity. To accomplish this, the handgun must be disassembled from time to time. One must have the proper tools to disassemble the handgun. Over the years since the introduction of the 1911 pistol, many developments and improvements have been made. Generally, 1911-style pistols come in two basic barrel styles, bushing and non-bushing (sometimes referred to as a "bull barrel"). Disassembly of a 1911 pistol requires recoil spring compression to enable removal of the recoil spring guide assembly from the slide and subsequent removal of the barrel for cleaning, repair, replacement, and the like.

Routine maintenance of handguns such as a 1911-style non-bushing/bull barrel pistol can be somewhat cumbersome and difficult because a tool is typically required to disassemble the handgun. In order to disassemble the handgun, the slide and barrel assembly must be removed from the frame of the gun. This is accomplished by retracting the slide, inserting a special takedown tool (or a L-shaped wire) in an aperture in the recoil spring guide rod, and then releasing tension to move the slide forward until the front of the slide rests against the takedown tool. This enables removal of the recoil spring guide assembly from the slide and provides for removal of the barrel. An apparatus that does not require a tool to accomplish the same result that is simple to manufacture would be desirable.

SUMMARY OF THE INVENTION

A recoil rod assembly for a semi-automatic firearm is provided. The recoil rod assembly includes a front rod portion having a front end, a rear end, and a longitudinal axis, and a rear rod portion having a front end, a rear end, and a longitudinal axis. The rear rod portion has substantially the same cross-section as the front rod portion. A cylindrical protuberance having a longitudinal axis is disposed at one of the rear end of the front rod portion and the front end of the rear rod portion. A cylindrical aperture having a longitudinal axis is disposed at the other of the rear end of the front rod portion and the front end of the rear rod portion. At least one of the longitudinal axis of the cylindrical protuberance and the longitudinal axis of the cylindrical aperture is offset from the longitudinal axis of the rear rod portion. A flange is disposed at the rear end of the rear rod portion to receive a recoil spring. The cylindrical protuberance is disposed in the cylindrical aperture, wherein the longitudinal axis of the cylindrical protuberance and the longitudinal axis of the cylindrical aperture are coaxial. The front rod portion is rotatable with respect to the rear rod portion about the coaxial longitudinal axes of the cylindrical protuberance and the cylindrical aperture from a first position wherein the longitudinal axis of the front rod portion is coaxial with the longitudinal axis of the rear rod portion to a second position wherein the longitudinal axis of the front rod portion is offset from the longitudinal axis of the rear rod portion, wherein a stepped surface on the rear end of the front rod is exposed.

The recoil rod assembly may further include an aperture in one of the front rod portion and the rear rod portion to receive a pin, the pin disposed in a groove in the other of the front rod portion and the rear rod portion to prevent separation of the front rod portion from the rear rod portion. The recoil rod assembly may further include a detent assembly that provides a tactile feel when the front rod portion is rotated from the first position to the second position and when the front rod portion is rotated from the second position to the first position. The detent assembly may include a detent spring and a pin that mates with at least one corresponding depression in the protuberance. The recoil rod assembly may be for is a 1911-style pistol.

A semi-automatic firearm is also provided wherein the firearm includes a frame and a slide, where the slide moveable from a retracted position whereby a recoil spring is fully compressed, to a closed position wherein the recoil spring is fully extended. The slide includes a recoil spring assembly which has a recoil spring, a recoil rod assembly, and a hollow recoil spring plug. The recoil spring has a first end, a second end, and a longitudinal axis. The recoil rod assembly includes a front rod portion having a front end, a rear end, and a longitudinal axis and a rear rod portion having a front end, a rear end, and a longitudinal axis. The rear rod portion has a substantially same cross-section as the front rod portion. A cylindrical protuberance having a longitudinal axis is disposed at one of the rear end of the front rod portion and the front end of the rear rod portion. A cylindrical aperture having a longitudinal axis is disposed at the other of the rear end of the front rod portion and the front end of the rear rod portion. At least one of the longitudinal axis of the cylindrical protuberance and the longitudinal axis of the cylindrical aperture is offset from the longitudinal axis of the rear rod portion. A flange is disposed at the rear end of the rear rod portion to receive the first end of the recoil spring. The cylindrical protuberance is disposed in the cylindrical aperture, wherein the longitudinal axis of the cylindrical protuberance and the longitudinal axis of the cylindrical aperture are coaxial. The hollow recoil spring plug has a first end having an aperture to slidingly receive the front rod portion and the rear rod portion, and a second end open to receive the second end of the recoil spring, wherein the recoil spring is captured within the hollow plug at the first end of the recoil spring plug. The front rod portion is rotatable with respect to the rear rod portion about the coaxial longitudinal axes of the cylindrical protuberance and the cylindrical aperture from a first position wherein the longitudinal axis of the front rod portion is coaxial with the longitudinal axis of the rear rod portion to a second position wherein the longitudinal axis of the front rod portion is offset from the longitudinal axis of the rear rod portion, wherein a stepped surface on the rear end of the front rod is exposed. When the slide is in the closed position, the recoil spring is in a fully extended position in the firearm, the first end of the recoil spring plug is disposed at the front end of the front rod portion wherein the longitudinal axis of the front rod portion is coaxial with the longitudinal axis of the rear rod portion. When the slide is in the retracted position, the recoil spring is in a fully compressed position in the firearm, the recoil spring plug is disposed at the front end of the rear rod portion, whereby the front rod portion rotatable with respect to the rear rod portion. When the stepped surface is exposed and the slide is released from its fully retracted position, the stepped surface is captured by the first end of the recoil spring plug, wherein the recoil spring is captured between the recoil spring plug and the flange. When the slide is removed from the frame, removal of the recoil spring assembly is facilitated without the use of a tool.

The recoil rod assembly may further include an aperture in one of the front rod portion and the rear rod portion to receive a pin, the pin disposed in a groove in the other of the front rod portion and the rear rod portion to prevent separation of the front rod portion from the rear rod portion. The recoil rod assembly may include a detent assembly that provides a tactile feel when the front rod portion is rotated from the first position to the second position and when the front rod portion is rotated from the second position to the first position. The detent assembly may include a detent spring and a pin that mates with at least one corresponding depression in the protuberance. The firearm may be a 1911-style pistol.

A semi-automatic firearm is also provided that includes a frame and slide, the slide moveable from a retracted position whereby a recoil spring is fully compressed, to a closed position wherein the recoil spring is fully extended, the slide including a recoil spring assembly. The recoil spring assembly includes the recoil spring having a first end, a second end, and a longitudinal axis. The recoil rod assembly includes a front rod portion having a front end, a rear end, and a longitudinal axis and a rear rod portion having a front end, a rear end, and a longitudinal axis. The rear rod portion has a substantially same cross-section as the front rod portion. A flange is provided at the rear end of the rear rod portion to receive the first end of the recoil spring. The front rod portion and the rear rod portion are rotatable about a longitudinal axis offset from the front rod longitudinal axis and the rear rod longitudinal axis. A hollow recoil spring plug is provided having a first end having an aperture to slidingly receive the front rod portion and the rear rod portion, and a second end open to receive the second end of the recoil spring, wherein the recoil spring is captured within the hollow plug at the first end of the recoil spring plug. The front rod portion is rotatable with respect to the rear rod portion from a first position wherein the longitudinal axis of the front rod portion is coaxial with the longitudinal axis of the rear rod portion to a second position wherein the longitudinal axis of the front rod portion is offset from the longitudinal axis of the rear rod portion, wherein a stepped surface on the rear end of the front rod is exposed. When the slide is in the closed position, the recoil spring is in a fully extended position in the firearm, the first end of the recoil spring plug is disposed at the front end of the front rod portion wherein the longitudinal axis of the front rod portion is coaxial with the longitudinal axis of the rear rod portion. When the slide is in the retracted position, the recoil spring is in a fully compressed position in the firearm, the recoil spring plug is disposed at the front end of the rear rod portion, whereby the front rod portion rotatable with respect to the rear rod portion. When the stepped surface is exposed and the slide is released from its fully retracted position, the stepped surface is captured by the first end of the recoil spring plug, wherein the recoil spring is captured between the recoil spring plug and the flange. When the slide is removed from the frame, removal of the recoil spring assembly is facilitated without the use of a tool.

The recoil rod assembly may further comprise a cylindrical protuberance having a longitudinal axis disposed at one of the rear end of the front rod portion and the front end of the rear rod portion, and a cylindrical aperture having a longitudinal axis disposed at the other of the rear end of the front rod portion and the front end of the rear rod portion. At least one of the longitudinal axis of the cylindrical protuberance and the longitudinal axis of the cylindrical aperture may be offset from the longitudinal axis of the rear rod portion. The cylindrical protuberance may be disposed in the cylindrical aperture, wherein the longitudinal axis of the cylindrical protuberance and the longitudinal axis of the cylindrical aperture are coaxial. The recoil rod assembly may further include an aperture in one of the front rod portion and the rear rod portion to receive a pin, the pin disposed in a groove in the other of the front rod portion and the rear rod portion to prevent separation of the front rod portion from the rear rod portion. The recoil rod assembly may further include a detent assembly that provides a tactile feel when the front rod portion is rotated from the first position to the second position and when the front rod portion is rotated from the second position to the first position. The detent assembly may include a detent spring and a pin that mates with at least one corresponding depression in the protuberance. The firearm may be a 1911-style pistol.

DETAILED DESCRIPTION

Figure 1:
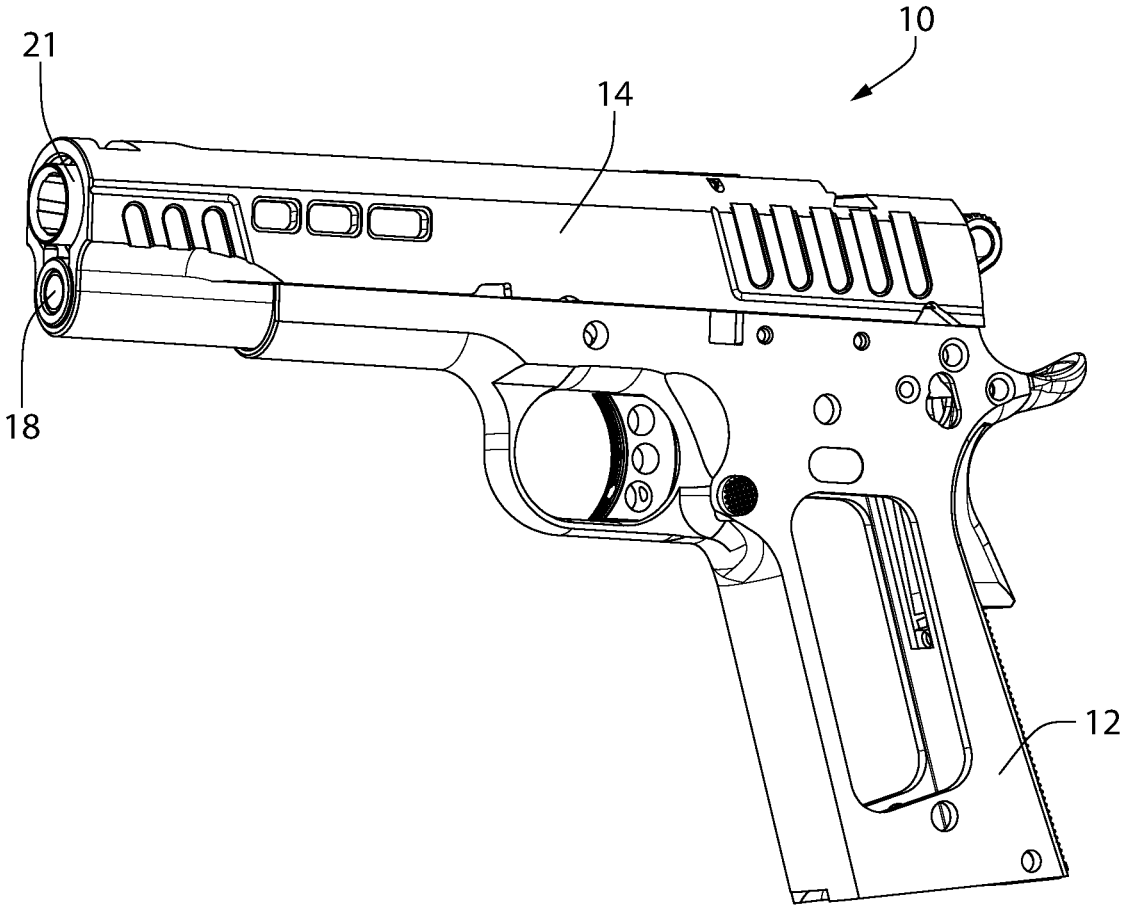
FIG. 1 is an isometric view of a 1911-style pistol having a recoil spring assembly facilitating tool-less takedown in accordance with an exemplary embodiment of the present invention, with grips, magazine, safety, and other elements removed for clarity.
Figure 2:
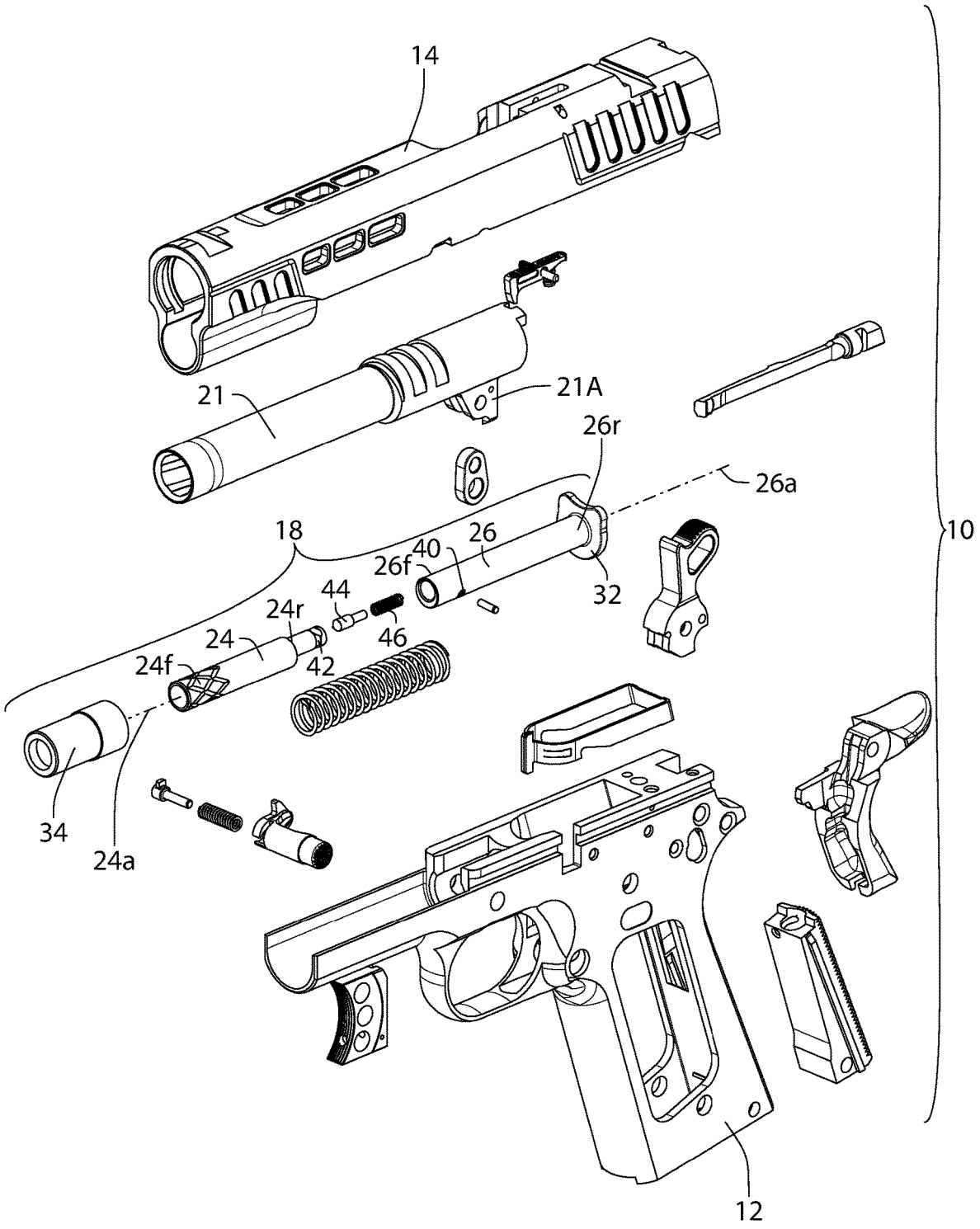
FIG. 2 is an exploded isometric view of the pistol of claim 1.

Referring now to the drawing figures wherein like reference numbers refer to like elements throughout the several views, there is shown in FIG. 1 a semi-automatic firearm having a recoil spring assembly to facilitate tool-less take down 10, in accordance with an exemplary embodiment of the present invention. FIG. 2 depicts an exploded view of the firearm 10. Certain elements are removed in FIGS. 1 and 2, including, for example, the grips, magazine, and safety. In this exemplary embodiment, the semi-automatic firearm 10 is a 1911-style pistol as is well known with its original design originally disclosed in U.S. Pat. No. 984,519 (Browning). However, it is contemplated that the present invention would operate for any firearm where the present invention would be useful, including both bushing style and non-bushing style firearms. However, for present purposes, the invention will be discussed as it relates to a non-bushing/bull barrel type of 1911-style firearm 10.

The firearm 10 of the present invention includes a frame 12 and slide 14 as commonly seen on 1911-style semi-automatic firearm. The slide 14 is moveable from a retracted position (as seen in FIGS. 10B-10D) where the slide is locked back by a slide stop (not shown), as is well known, to a closed and ready to fire position (as seen in FIGS. 1 and 10A). The firearm 10 further includes a recoil spring assembly 18 (see FIGS. 3-8, 9A-9C and 10A-10G) disposed within the slide 14 (again, in the usual manner as is well known). When disassembling the firearm 10 for cleaning, repair, replacement of parts, and the like, the recoil spring assembly 18 must be easily separable from the slide 14, without also applying substantial spring force on other elements of the firearm 10 such as the barrel 21.

The recoil spring assembly 18 includes a recoil spring 20 (having a first end 20*f* and a second end 20*s*), a recoil rod assembly 22, and a recoil spring plug 34 and other elements described below. Separation of the recoil spring assembly 18 from the slide 14 requires compression of a recoil spring 20 to relieve force of the recoil spring assembly 18 against the barrel lug 21A of the barrel 21 such that the recoil spring assembly 18, as a unit, may be removed from the slide 14 for removal, cleaning, and repair. Subsequently, the barrel 21 of the firearm 10 may be slid out of the slide 14 for removal, cleaning, and repair.

As noted, the present invention is primarily directed to a non-bushing/bull barrel type 1911-style firearm 10. With such a firearm, compression of the recoil spring to relieve the force is difficult and typically requires an L-shaped tool that is inserted into an aperture in a one-piece recoil spring rod (as known). Rather than using an L-shaped tool disposed in an aperture in the recoil spring rod of a prior art pistol, the present invention is directed to a tool-less design which utilizes a unique multi-part recoil rod assembly 22.

Figure 3:
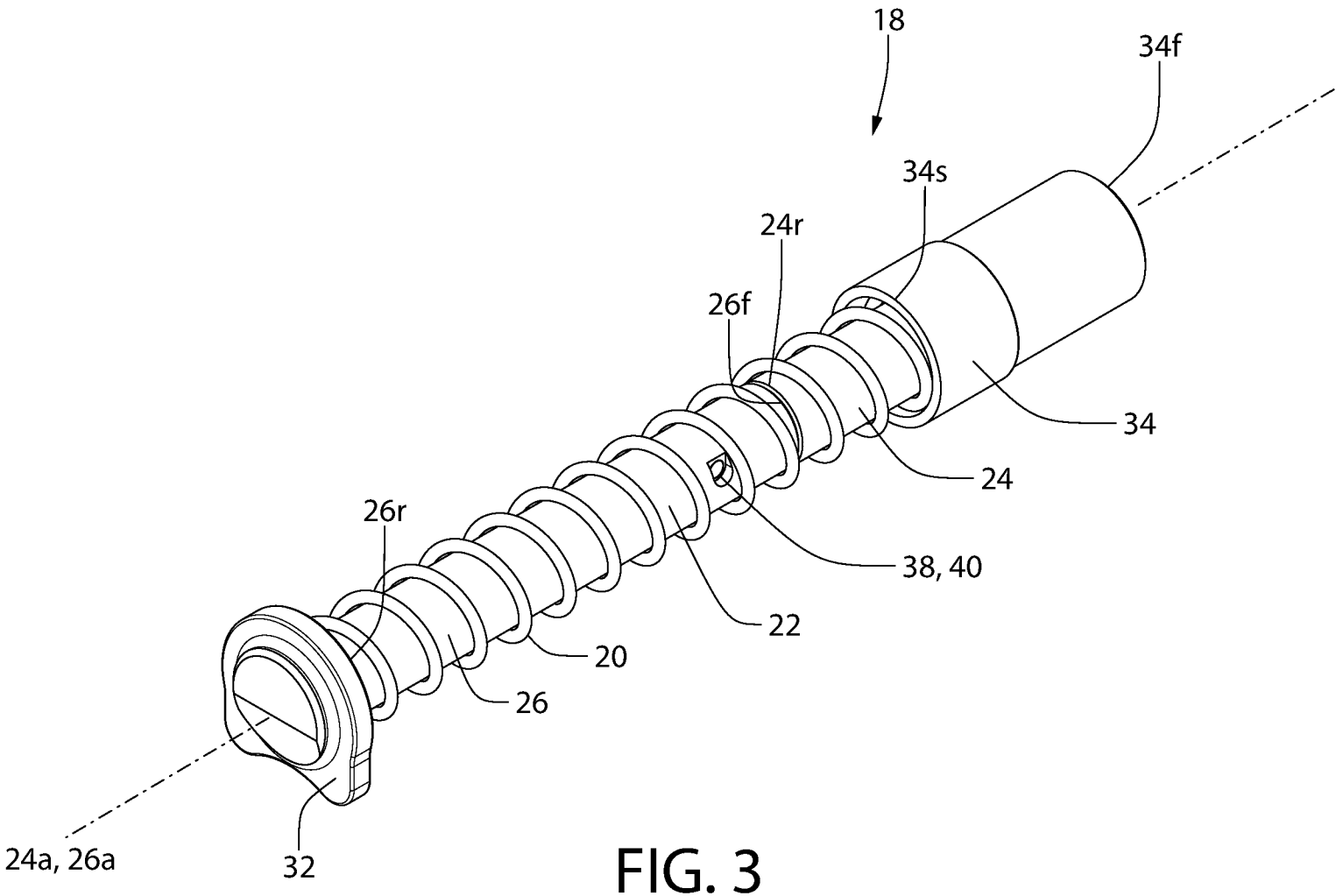
FIG. 3 is an isometric bottom view of a recoil spring assembly of the pistol of FIG. 1.
Figure 4:
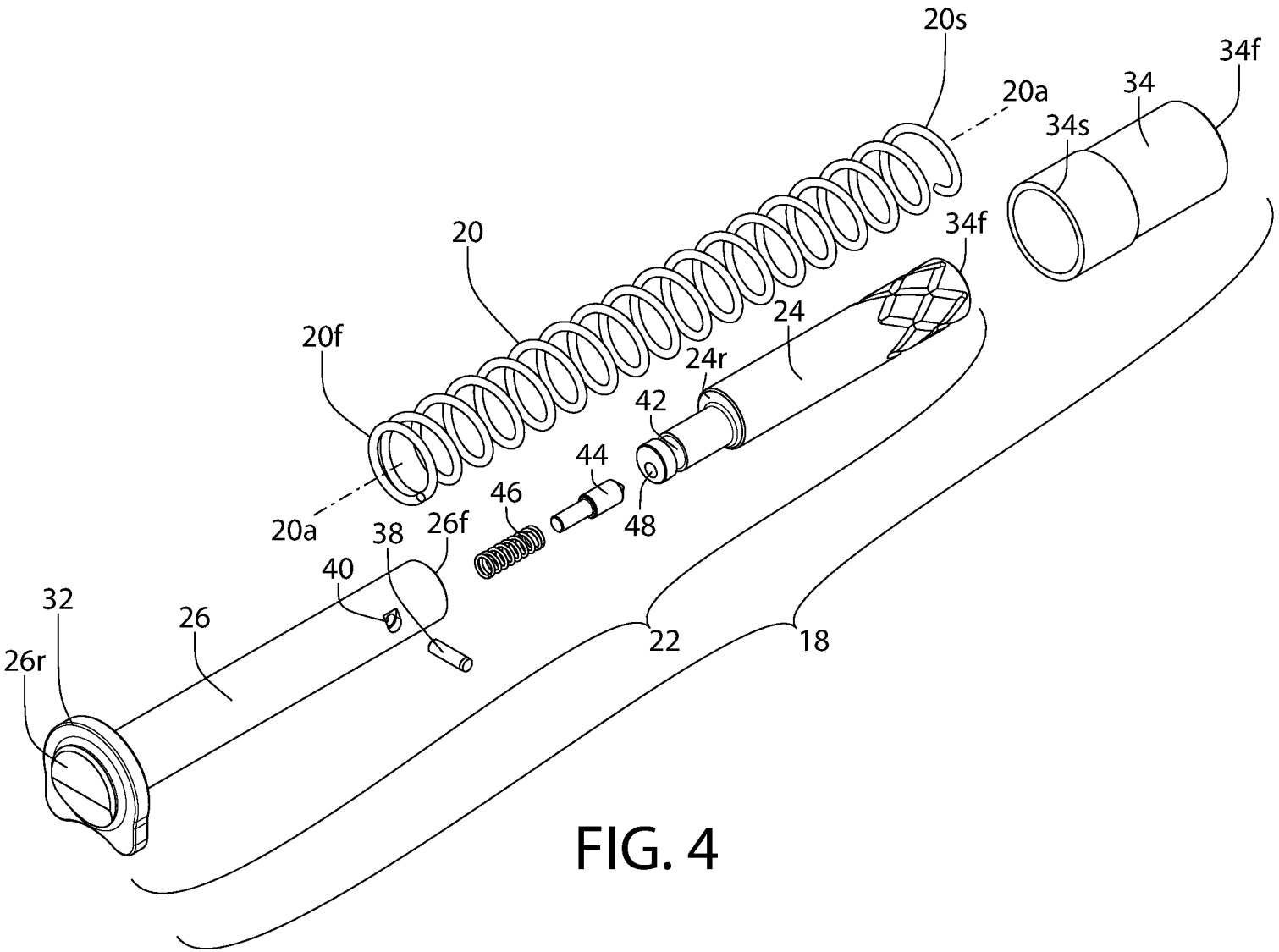
FIG. 4 is an exploded bottom isometric view of the recoil spring assembly of FIG. 3.
Figure 5:
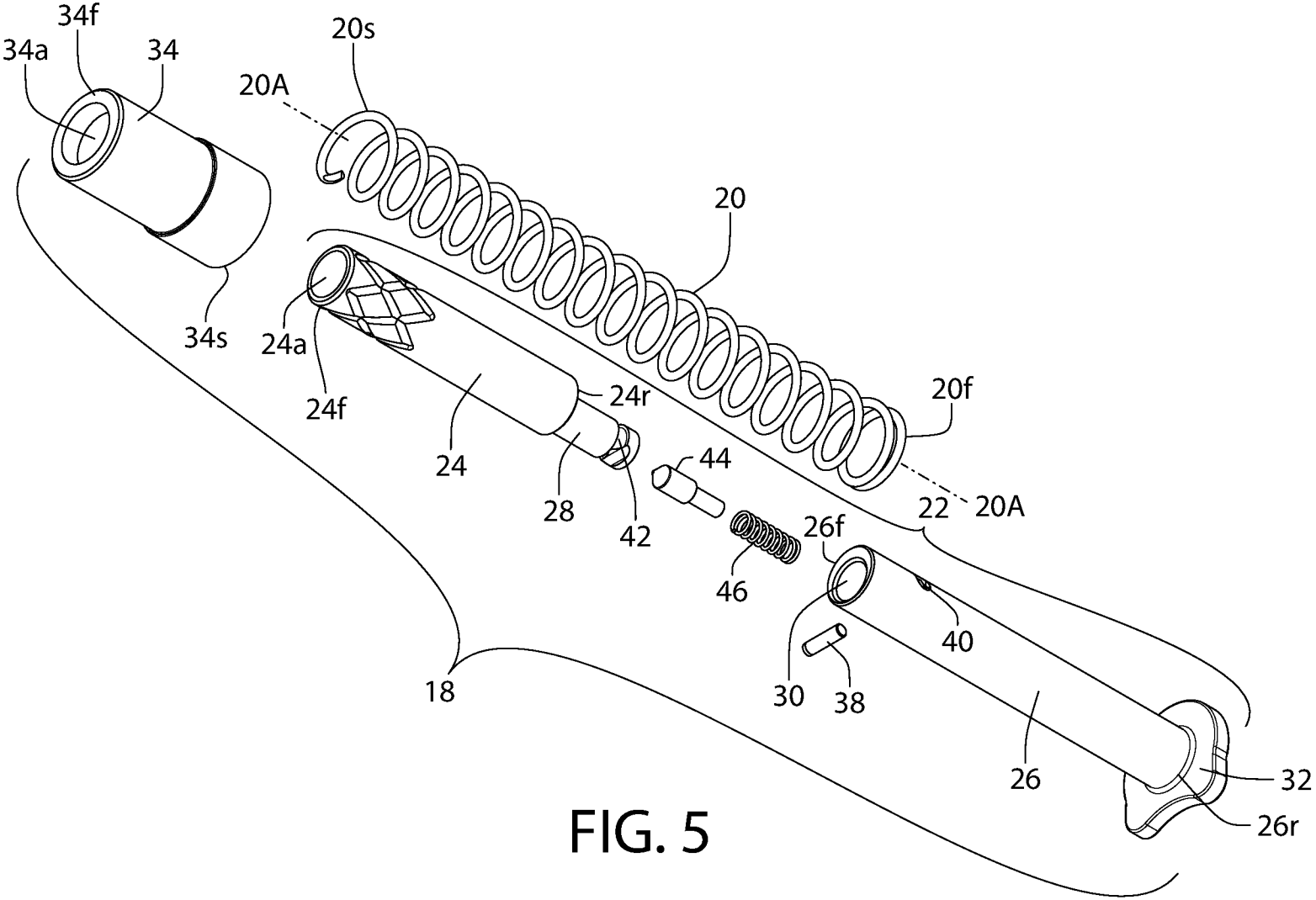
FIG. 5 is an exploded top isometric view of the recoil spring assembly of FIG. 3.
Figure 5A:
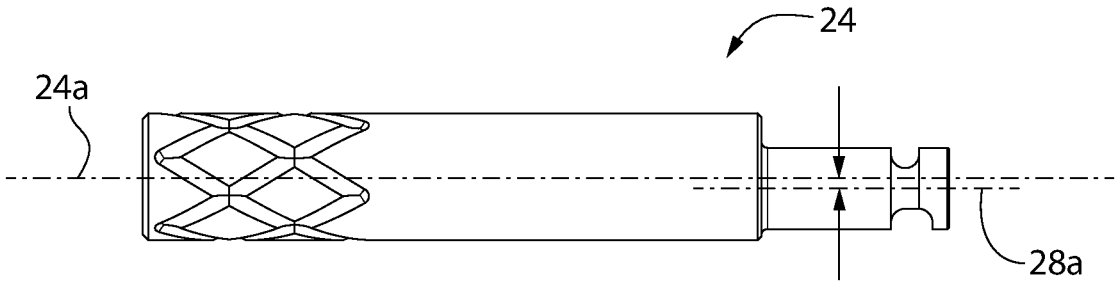
FIG. 5A is a side elevation view of a front rod portion of the recoil spring assembly of FIG. 3.
Figure 5B:
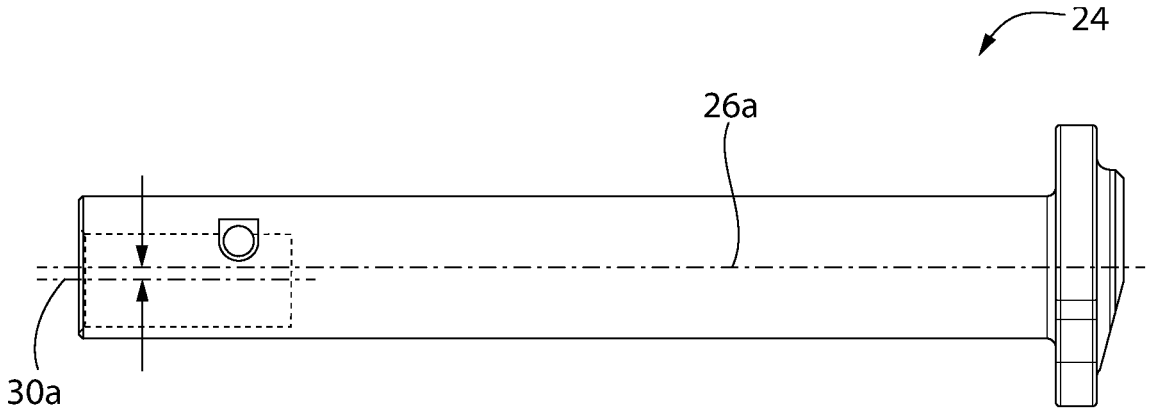
FIG. 5B is a side elevation view of a rear rod portion of the recoil spring assembly of FIG. 3.
Figure 6:
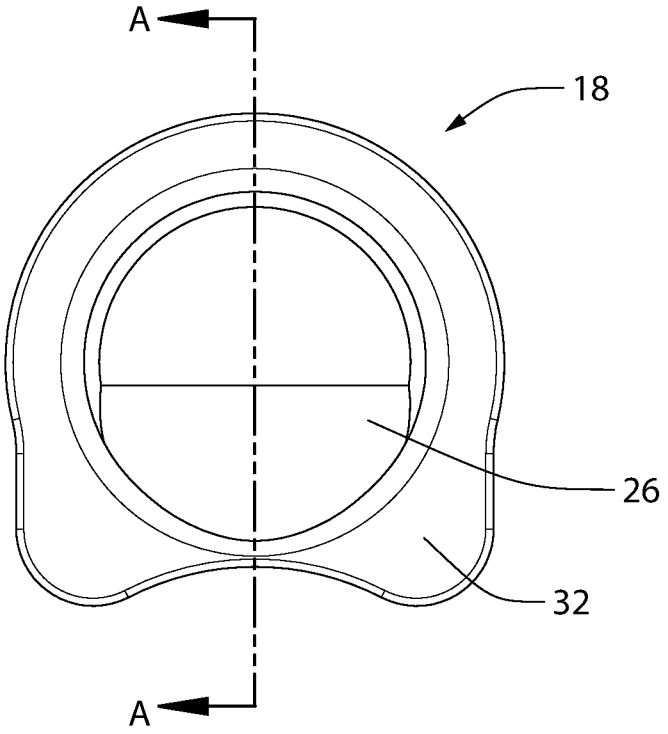
FIG. 6 is a rear elevation view of the recoil spring assembly of FIG. 3.
Figure 7:
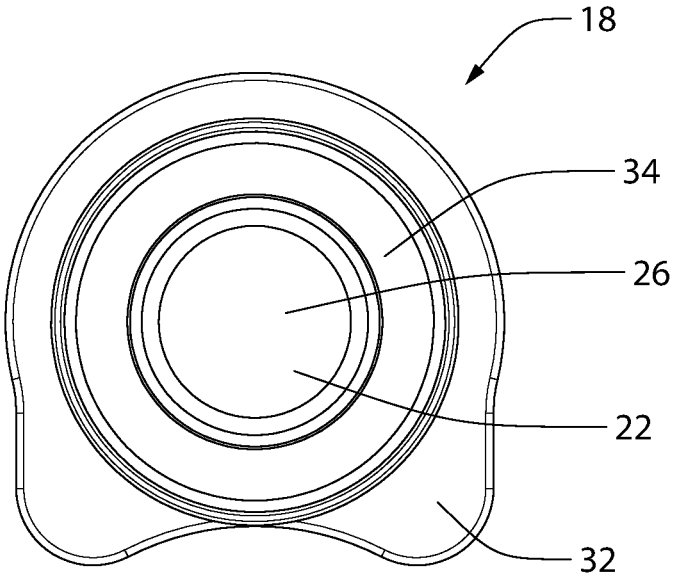
FIG. 7 is a front elevation view of the recoil spring assembly of FIG. 3.
Figure 8:
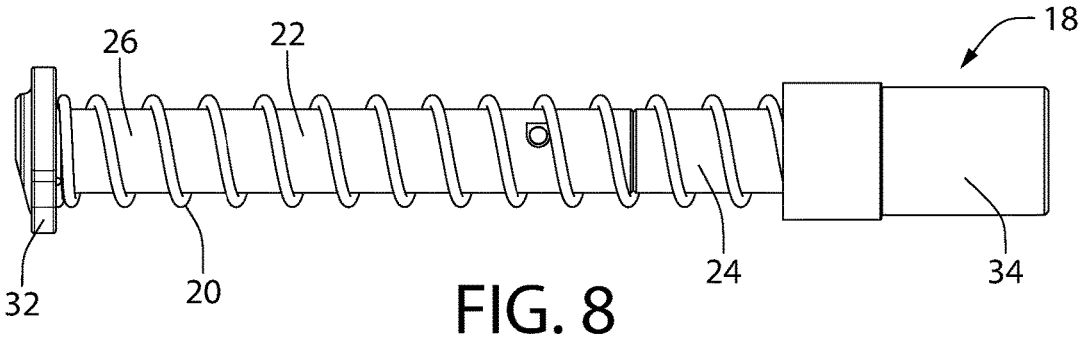
FIG. 8 is a side elevation view of the recoil spring assembly of FIG. 3, shown with a recoil spring plug in a position as in an assembled pistol in a normal operating condition, with the slide fully closed.

As best seen in FIGS. 3-5, the recoil rod assembly 22 of the present invention includes a front rod portion 24 having a front end 24*f* and a rear end 24*r*, and a longitudinal axis 24*a*. The recoil rod assembly 22 also includes a rear rod portion 26 having a front end 26*f*, a rear end 26*r*, a longitudinal axis. The cross-sectional shape of the front rod portion 24 is substantially the same as the cross-sectional shape of the rear rod portion 26, thereby providing for a smooth rod shape effectively operating as a unitary rod when the front rod portion 24 and the rear rod portion 26 are properly oriented with respect to each other in a condition where the firearm is ready to fire.

The rear end 24*r* of the front rod portion 24 is rotatably disposed on the front end 26*f* of the rear rod portion 26 as follows. A cylindrical protuberance 28 is disposed on either the rear end 24*r* of the front rod portion 24 or the front end 26*f* of the rear rod portion 26. As shown in the figures herein, the cylindrical protuberance 28 is disposed on the rear end 24*r* of the front rod portion. The cylindrical protuberance 28 has a longitudinal axis 28*a*. A corresponding cylindrical aperture 30 is disposed on the other of the rear end 24 of the front rod portion 24 or the front end 26*f* of the rear rod portion 26. As shown in the figures herein, the cylindrical aperture 30 is disposed on front end 26*f* of the rear rod portion 26. The cylindrical aperture 30 has a longitudinal axis 30*a*.

Importantly, the longitudinal axis 28*a* of the cylindrical protuberance 28 and the longitudinal axis 30*a* of the cylindrical aperture are offset from one another, thereby providing for the longitudinal axis 24A of the front rod portion 24 to be in alignment with the longitudinal axis 26 of the rear rod portion 26, whereby their cross-sectional shapes may be aligned or non-aligned, depending upon the rotation position. That is, when the cylindrical protuberance is disposed in the cylindrical aperture, the longitudinal axis of the cylindrical protuberance and the longitudinal axis of the cylindrical aperture may be in a first position that is coaxial to a second position that is not coaxial.

A flange 32 is provided at the rear end 26*r* of the rear rod portion 26 to receive the first end 20*f* of the recoil spring 20. The flange 32 is a type typically seen on 1911-style recoil rods. A hollow recoil spring plug 34 is provided that has a first end 34*f* having an aperture 34*a* (see FIG. 5) to slidingly receive the front end 24*f* of the front rod portion 24. The recoil spring plug 34 has a second end 34*s* open to receive the second end 20*s* of the recoil spring 20, wherein the recoil spring 20 is captured within the hollow plug 34 at the second end 34*s* of the hollow plug 34.

The front rod portion 24 is rotatable with respect to the rear rod portion 26 about the coaxial longitudinal axis 28*a* of the cylindrical protuberance 28 and the longitudinal axis 30*a* of the cylindrical aperture 30 from a first position (see FIGS. 9A, 9B) wherein the longitudinal axis 24*a* of the front rod portion 24 is coaxial with the longitudinal axis 26*a* of the rear rod portion 26, to a second position (see FIG. 9C) wherein the longitudinal axis 24*a* of the front rod portion 24 is offset from the longitudinal axis 26*a* of the rear rod portion 26. When in the second position, an annular surface 24*a* on the rear end 24*a* of the of the front rod portion 24 and annular surface 26*a* at the front end 26*f* of the rear rod portion 26 are not in alignment, thereby exposing a stepped surface 24*s* on the rear end 24*r* of the front rod portion 24 (see FIGS. 9C, 10C-10E).

When the slide 14 is in the closed (i.e., ready-to-fire) position on the frame 12 of the firearm 10, the recoil spring 20 is in a fully extended position in the firearm 10, the first end 34*f* of the recoil spring plug 34 is disposed at the front end 24*f* of the front rod portion 24. See FIGS. 8, 9A and 10A. In this configuration, the front rod portion 24 is not rotatable with respect to the rear rod portion 26.

When the slide 14 is in a fully retracted position, the recoil spring 20 is in a fully compressed position in the firearm 10, the recoil spring plug 34 is disposed at the front end 26*f* of the rear rod portion 26, whereby the front rod portion 24 is rotatable with respect to the rear rod portion 26. See FIGS. 10B, 10C, 10D.

When the slide 14 is in the fully retracted position, the front rod portion 24 may be rotated with respect to the rear rod portion 26 and the stepped surface 24*s* on the rear end 24*r* of the front rod is exposed. Releasing the slide 14 from its fully retracted position by releasing the slide lock (in the usual manner for a 1911-style pistol) causes slide 14 to move forward under the force of the recoil spring 20, wherein the stepped surface 24*s* of the front rod portion 24 engages with the first end 24*f* of the recoil spring plug 34. whereby the recoil spring plug 34 is held in position at the front end 26*f* of the rear rod portion 26. Force from the recoil spring 20 is thereby captured within the recoil spring assembly 18 between the stepped surface 24*s* of the front rod portion acting against the recoil spring plug 34 and the flange 32 of the rear rod portion 26. As such, when the slide 14 is removed from the frame 12, removal of the recoil spring assembly 18 is facilitated without the use of a tool.

A feature of the recoil rod assembly 22 may be a means to capture the front rod portion 24 and the rear rod portion. This may be in the form of a pin 38 disposed in an aperture 40 in the rear rod portion 26*f* that engages a groove 42 in the cylindrical protuberance 28.

Figure 9A:
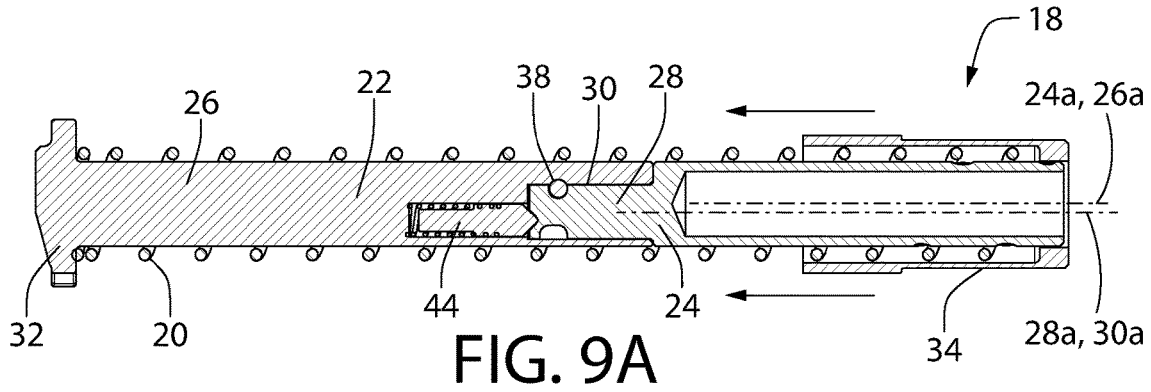
FIG. 9A is a cross sectional view of the recoil spring assembly of FIG. 3, taken along lines A--A of FIG. 6, shown with a recoil spring plug in the position of FIG. 8.
Figure 9B:
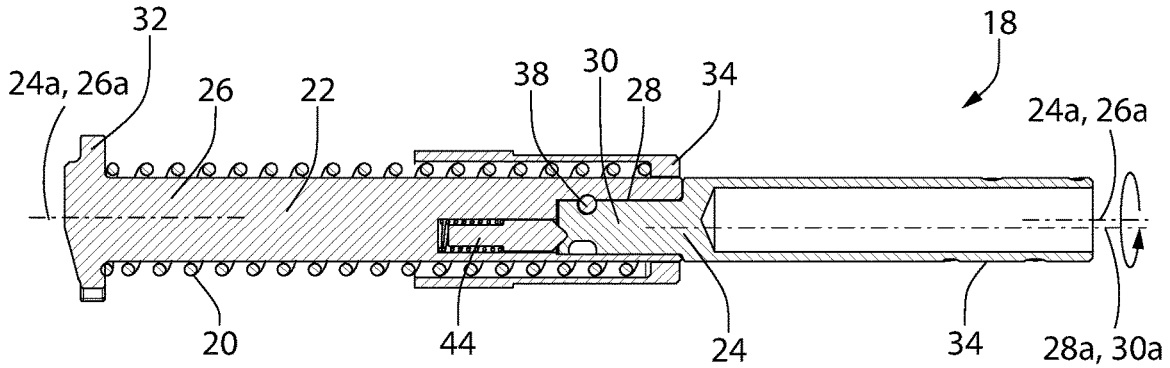
FIG. 9B is a cross sectional view of the recoil spring assembly of FIG. 3, taken along lines A--A of FIG. 6, shown with a recoil spring plug in a position of an assembled pistol in a normal operating condition, with the slide positioned rearward and fully open, wherein a multi-piece guide rod is disposed in a normal operational configuration when the pistol is operational.
Figure 9C:
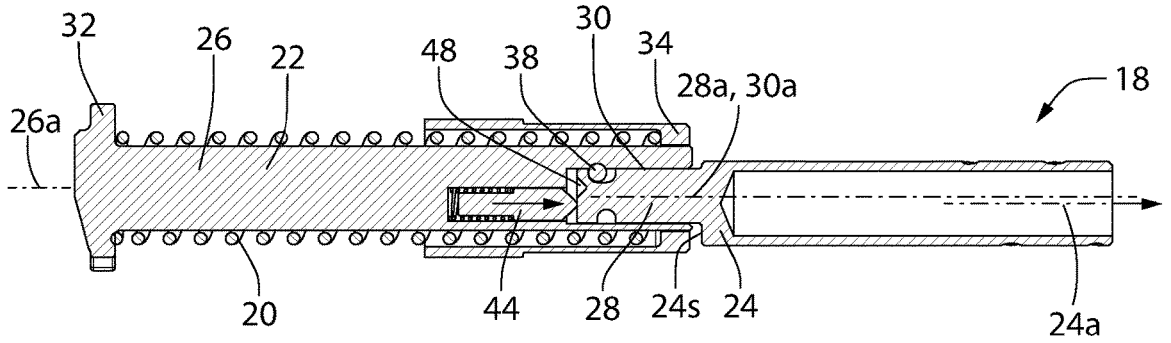
FIG. 9C is a cross sectional view of the recoil spring assembly of FIG. 3, taken along lines A--A of FIG. 6, shown with a recoil spring plug in a position of an assembled pistol for a removal of the recoil spring assembly, with the slide positioned rearward and fully open, wherein a front rod portion and a rear rod portion are disposed in a configuration wherein the recoil spring assembly may be removed from the slide.
Figure 9D:
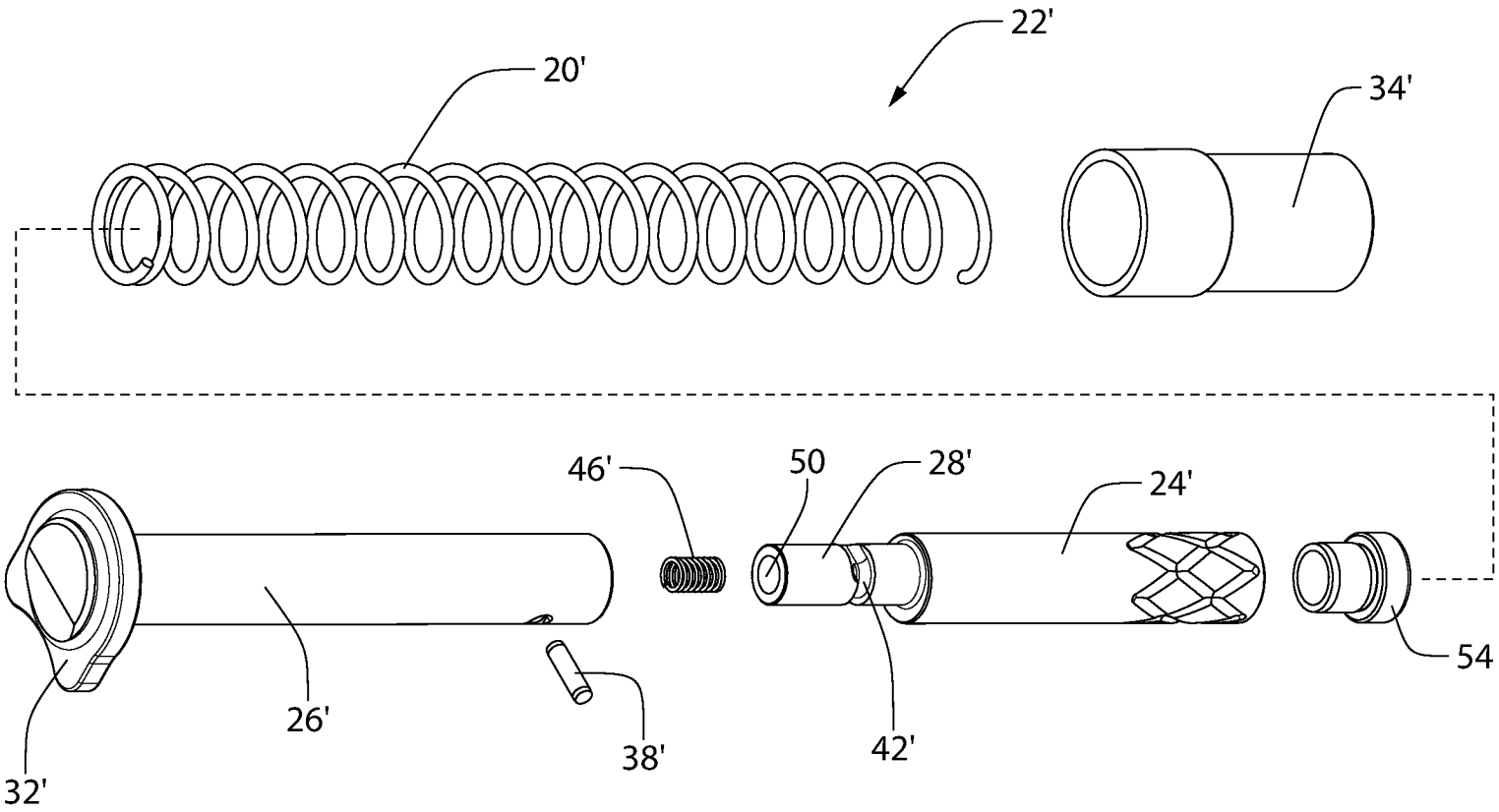
FIG. 9D is a bottom, isometric exploded view of an alternate exemplary embodiment of a recoil spring assembly.
Figure 9E:
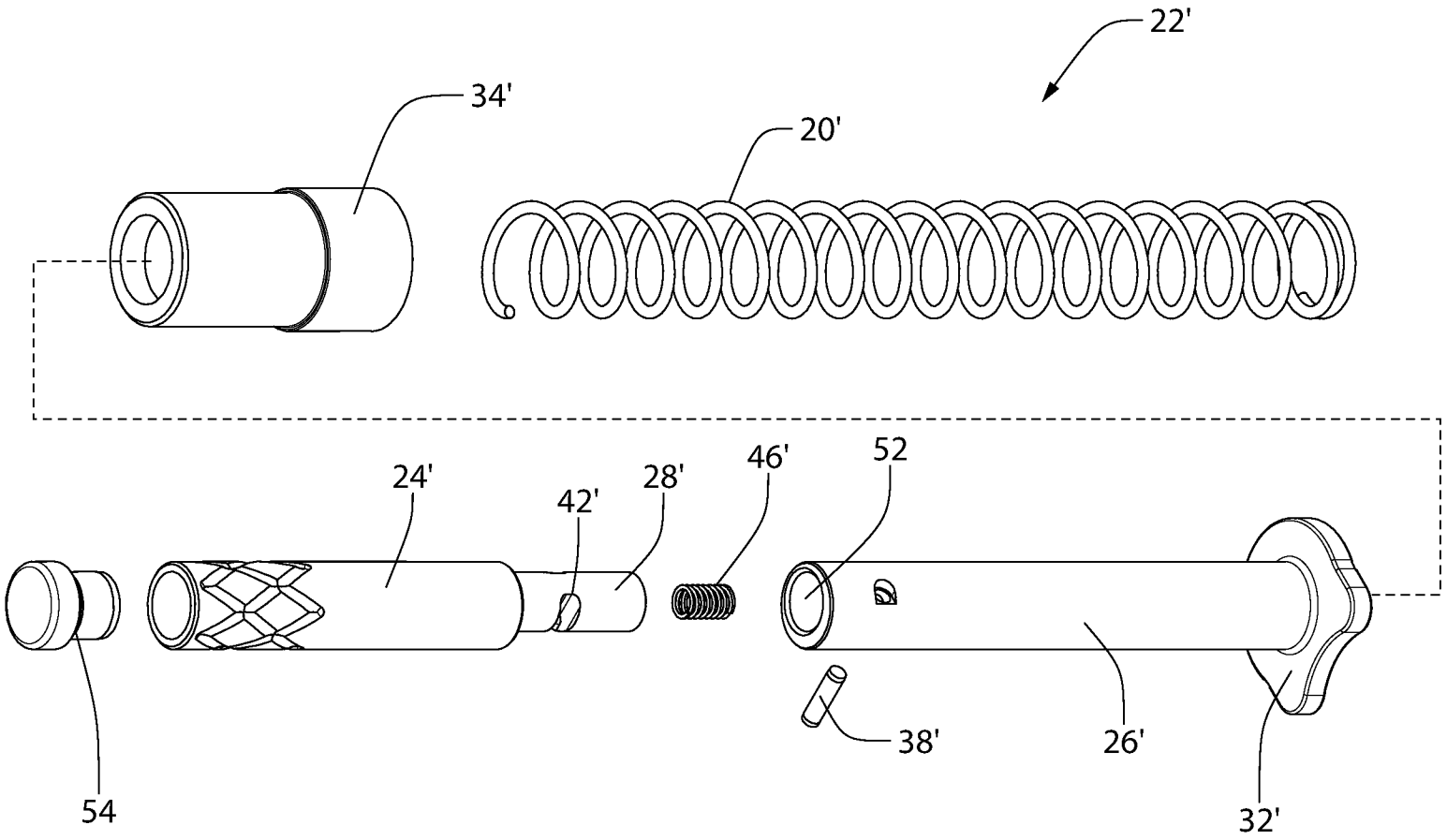
FIG. 9E a top, isometric exploded view of the alternate exemplary embodiment of the recoil spring assembly of FIG. 9D
Figure 9F:
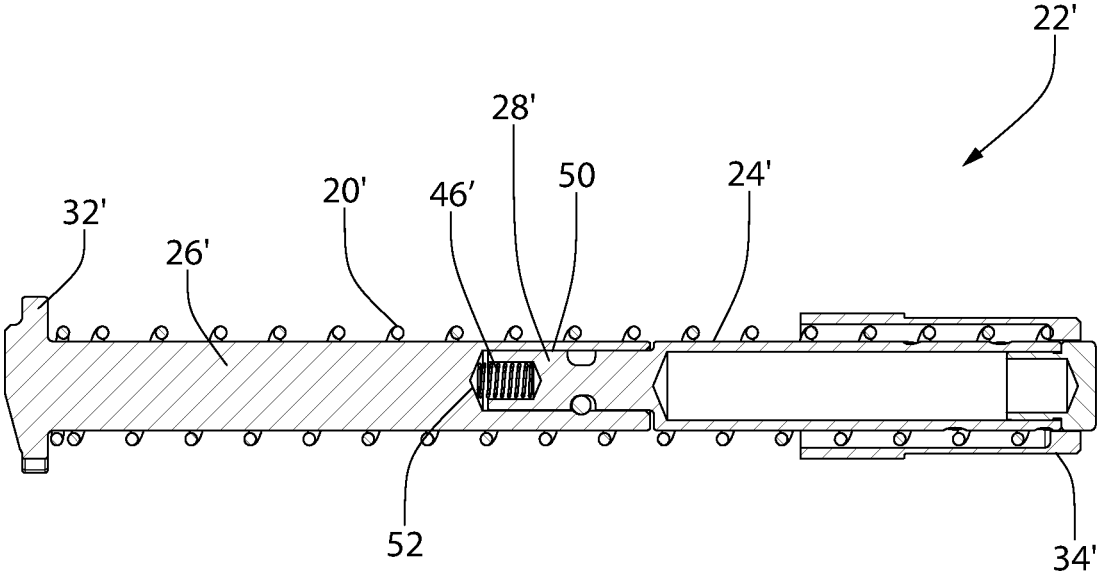
FIG. 9F is a cross sectional view of the recoil spring assembly of FIG. 9D, shown with a recoil spring plug in a position of an assembled pistol in a normal operating condition, with the slide fully closed.
Figure 9G:
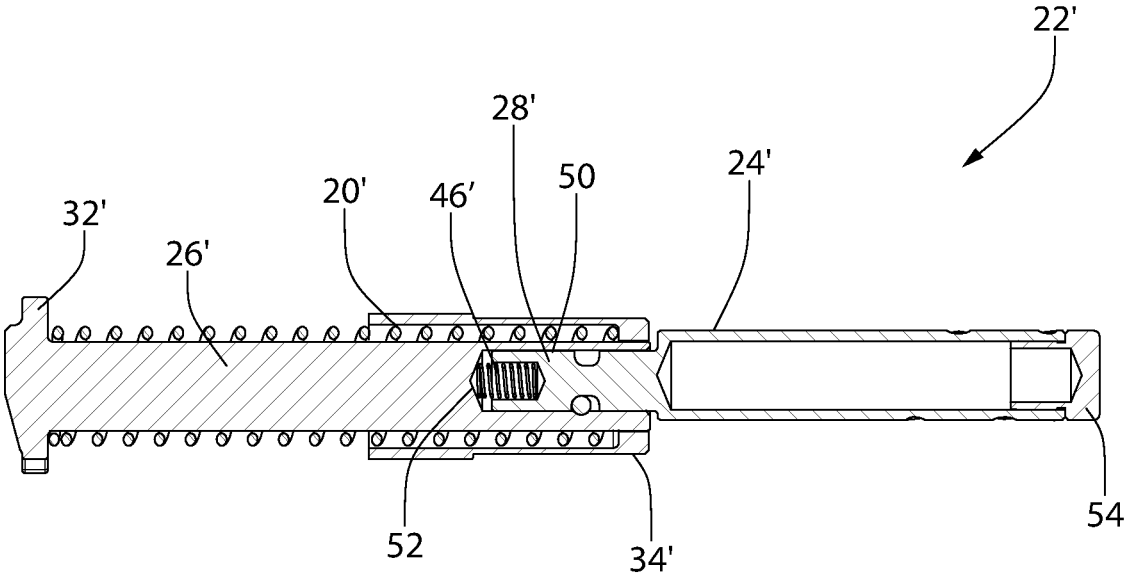
FIG. 9G is a cross sectional view of the recoil spring assembly of FIG. 9D, shown with the recoil spring plug in a position for removal of the recoil spring assembly, with the slide positioned rearward and fully open, wherein a front rod portion and a rear rod portion are disposed in a configuration wherein the recoil spring assembly may be removed from the slide.
Figure 10A:
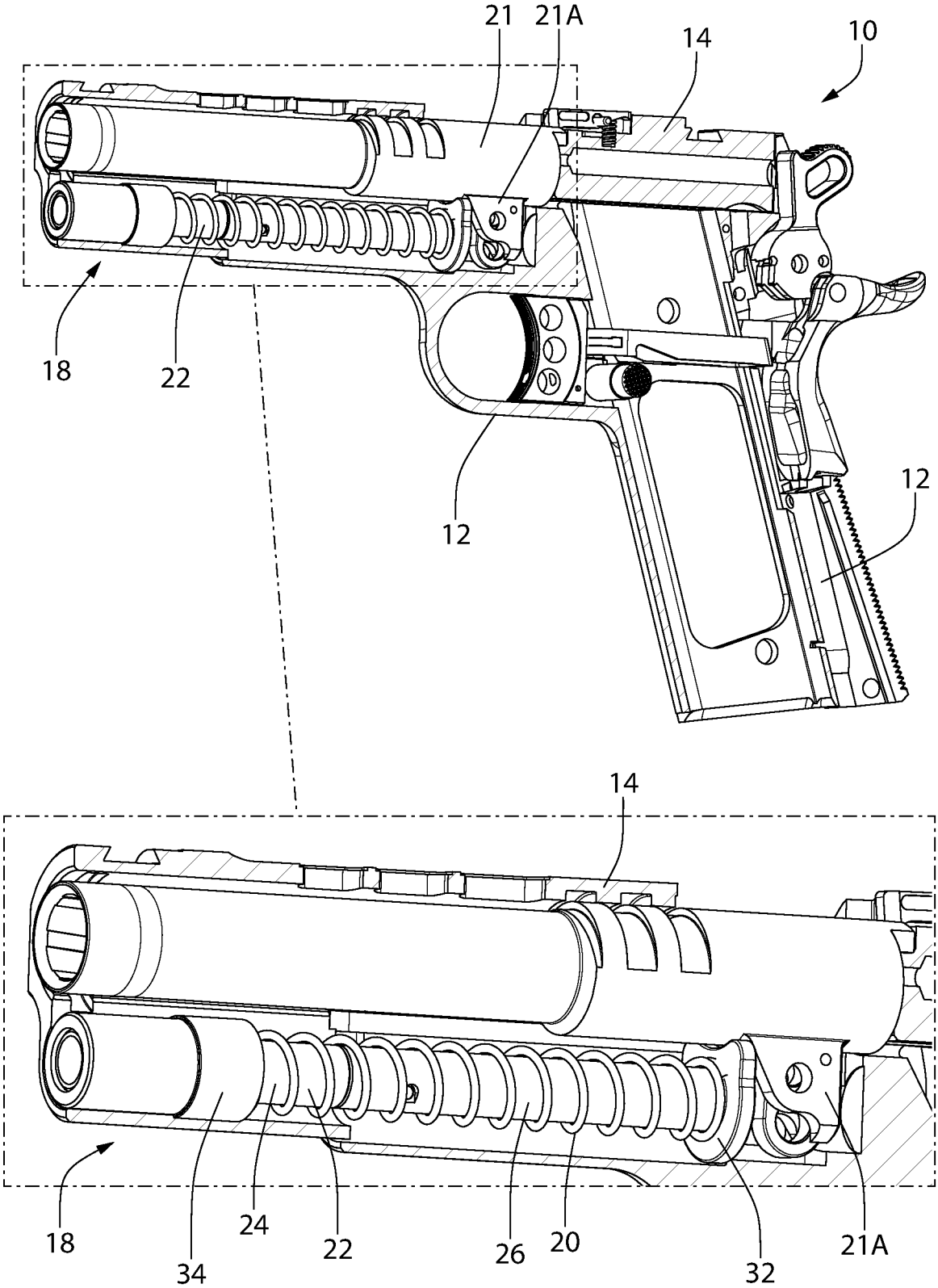
FIG. 10A is a cross-sectional view of the pistol of FIG. 1, shown with a portion enlarged, and shown in a position of an assembled pistol in a normal operating condition, with the slide in a fully closed position, and in a configuration wherein the pistol is operational, wherein the recoil spring assembly is applying force between the barrel and the slide.
Figure 10B:
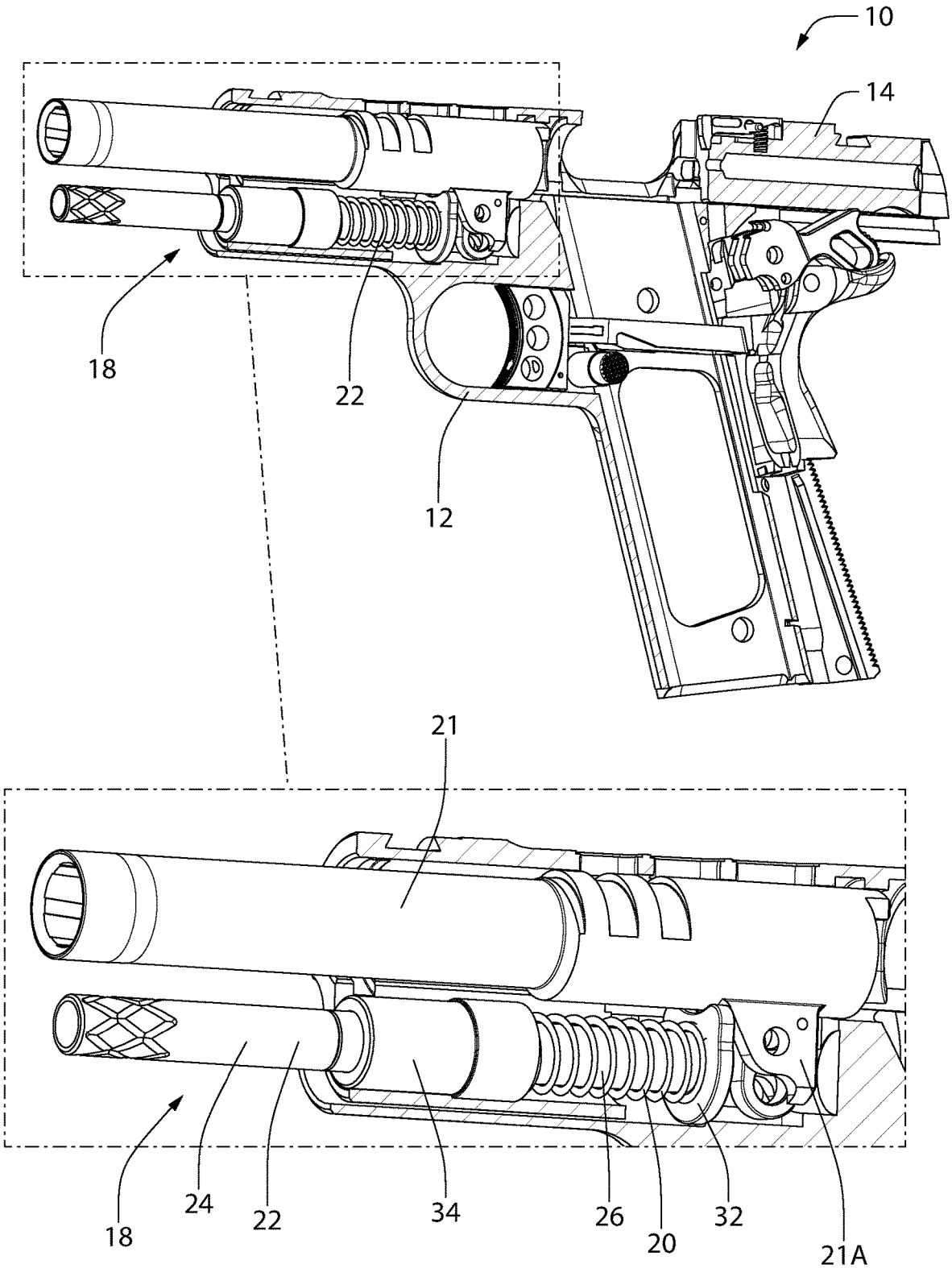
FIG. 10B is a cross-sectional view of the pistol of FIG. 1, shown with a portion enlarged, and shown in a position of an assembled pistol with the slide in a fully retracted position, wherein the recoil spring assembly is applying force between the barrel and the slide, and wherein a front rod portion and a rear rod portion are disposed in a normal operational configuration.
Figure 10C:
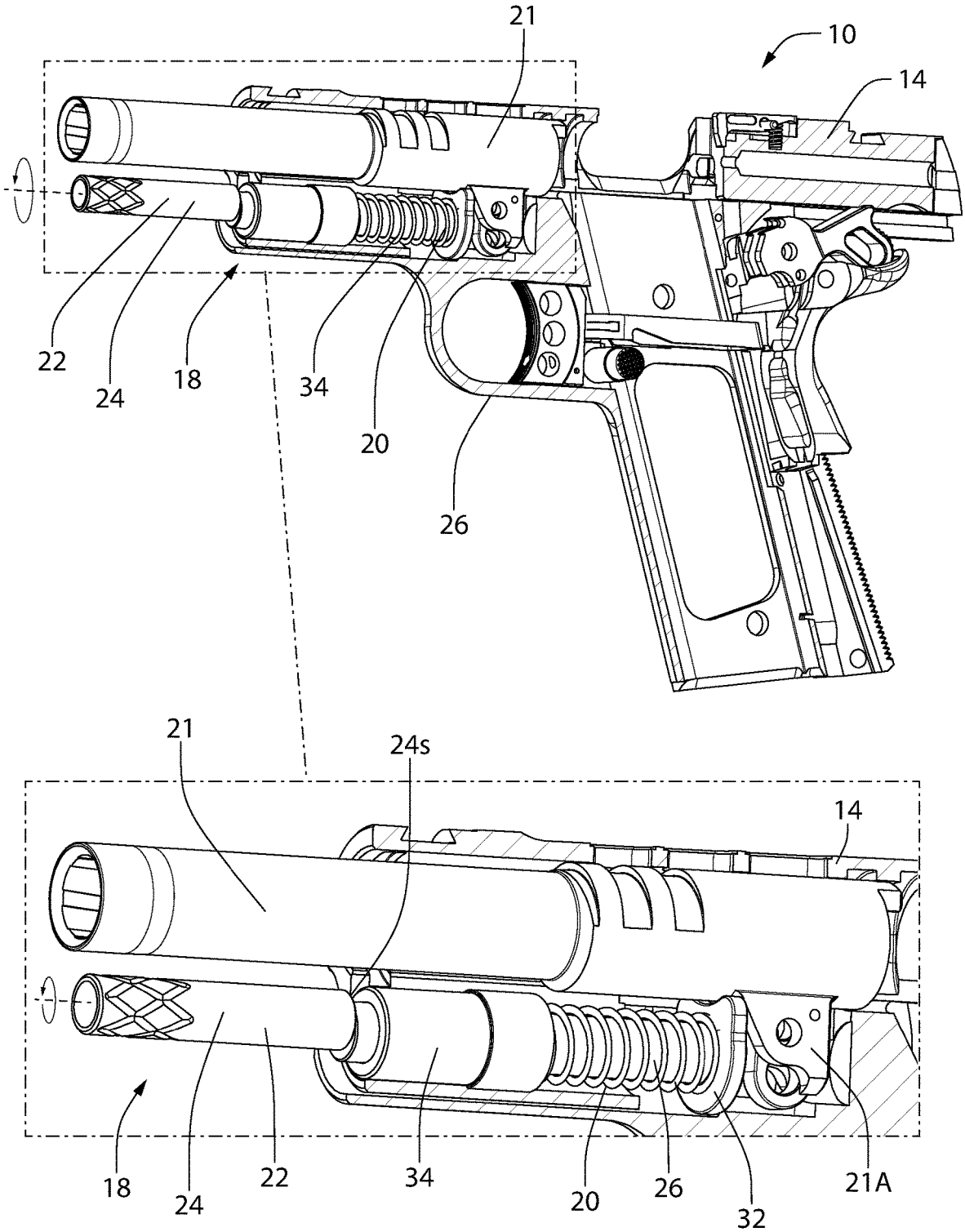
FIG. 10C is a cross-sectional view of the pistol of FIG. 1, shown with a portion enlarged, and shown in a position of an assembled pistol with the slide in a fully retracted position, and wherein a front rod portion and a rear rod portion are shown in full (i.e., not in cross-section), wherein the recoil spring assembly is applying force between the barrel and the slide, wherein the recoil spring assembly is disposed in the configuration to facilitate removal of FIG. 10B.
Figure 10D:
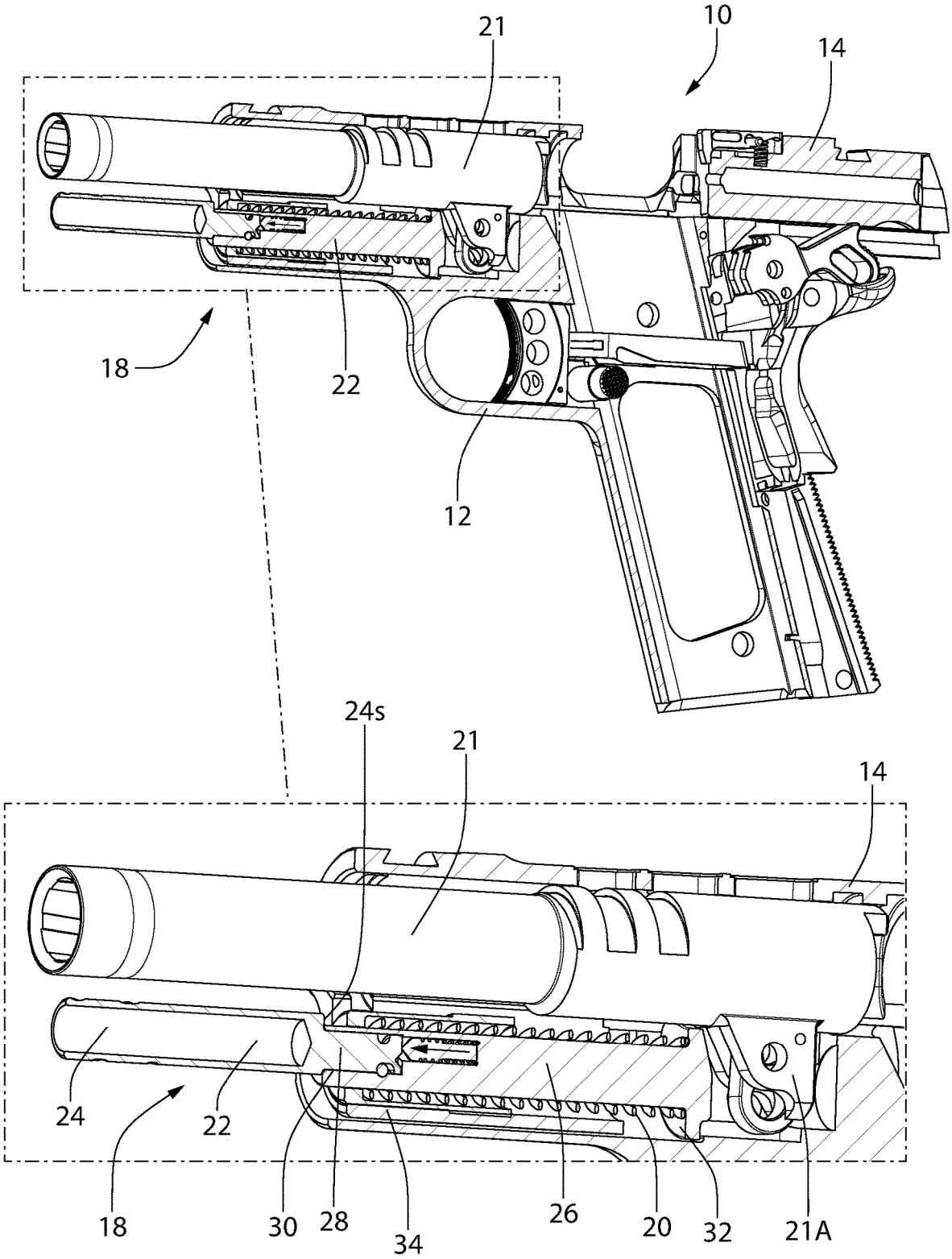
FIG. 10D is a cross-sectional view of the pistol of FIG. 1, shown with a portion enlarged, and shown in a position of an assembled pistol with the slide in a fully retracted position, and wherein a front rod portion and a rear rod portion are shown in cross-section, wherein the recoil spring assembly is applying force between the barrel and the slide, wherein the recoil spring assembly is disposed in the configuration to facilitate removal of FIG. 10C, with the front rod portion pressed longitudinally inward to facilitate rotation of the front rod portion with respect to the rear rod portion.
Figure 10E:
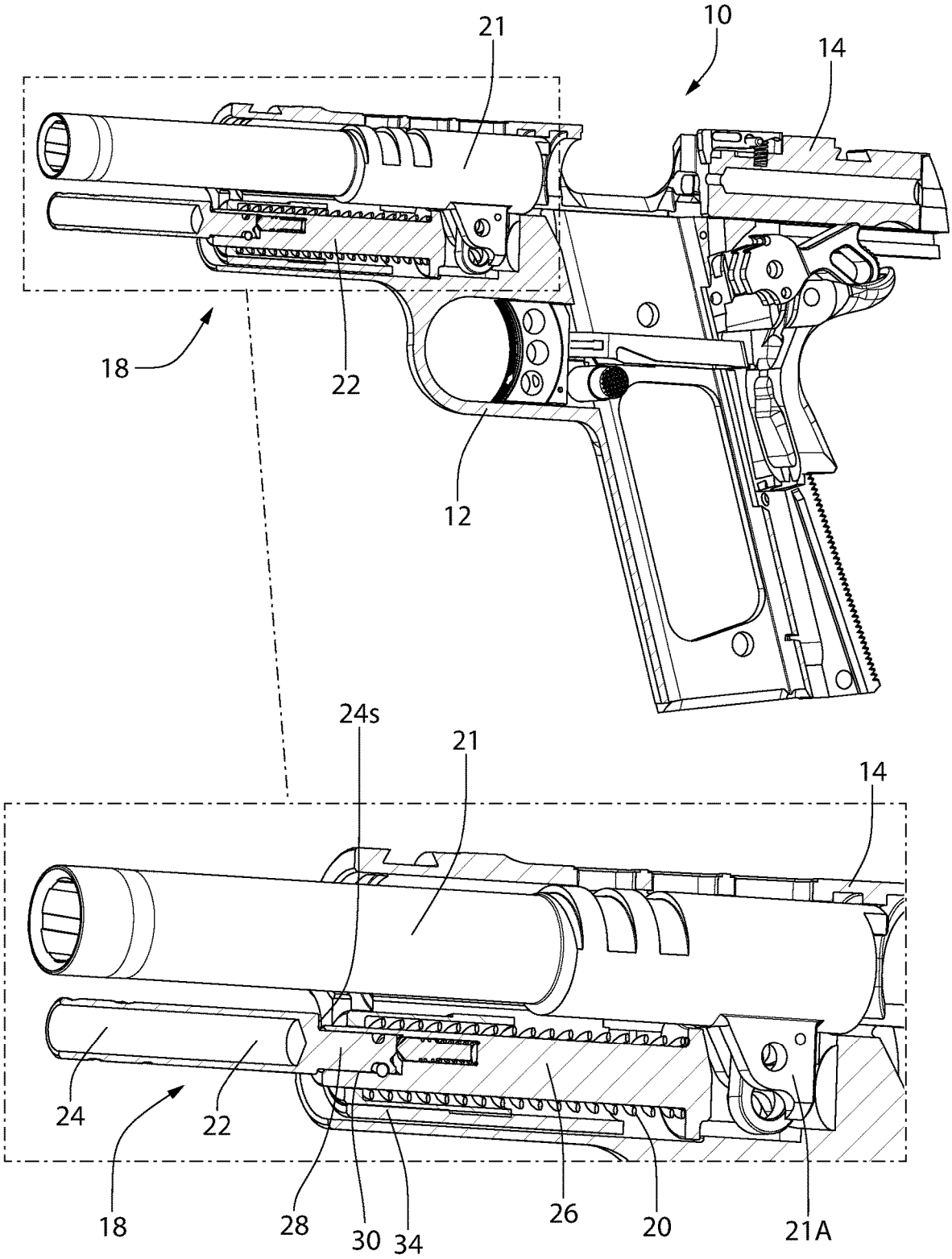
FIG. 10E is a cross-sectional view of the pistol of FIG. 1, as in FIG. 10D, but shown with the front rod portion longitudinally outward to lock rotation of the front rod portion with respect to the rear rod portion to prevent accidental rotation, wherein the recoil spring assembly is applying force between the barrel and the slide.
Figure 10F:
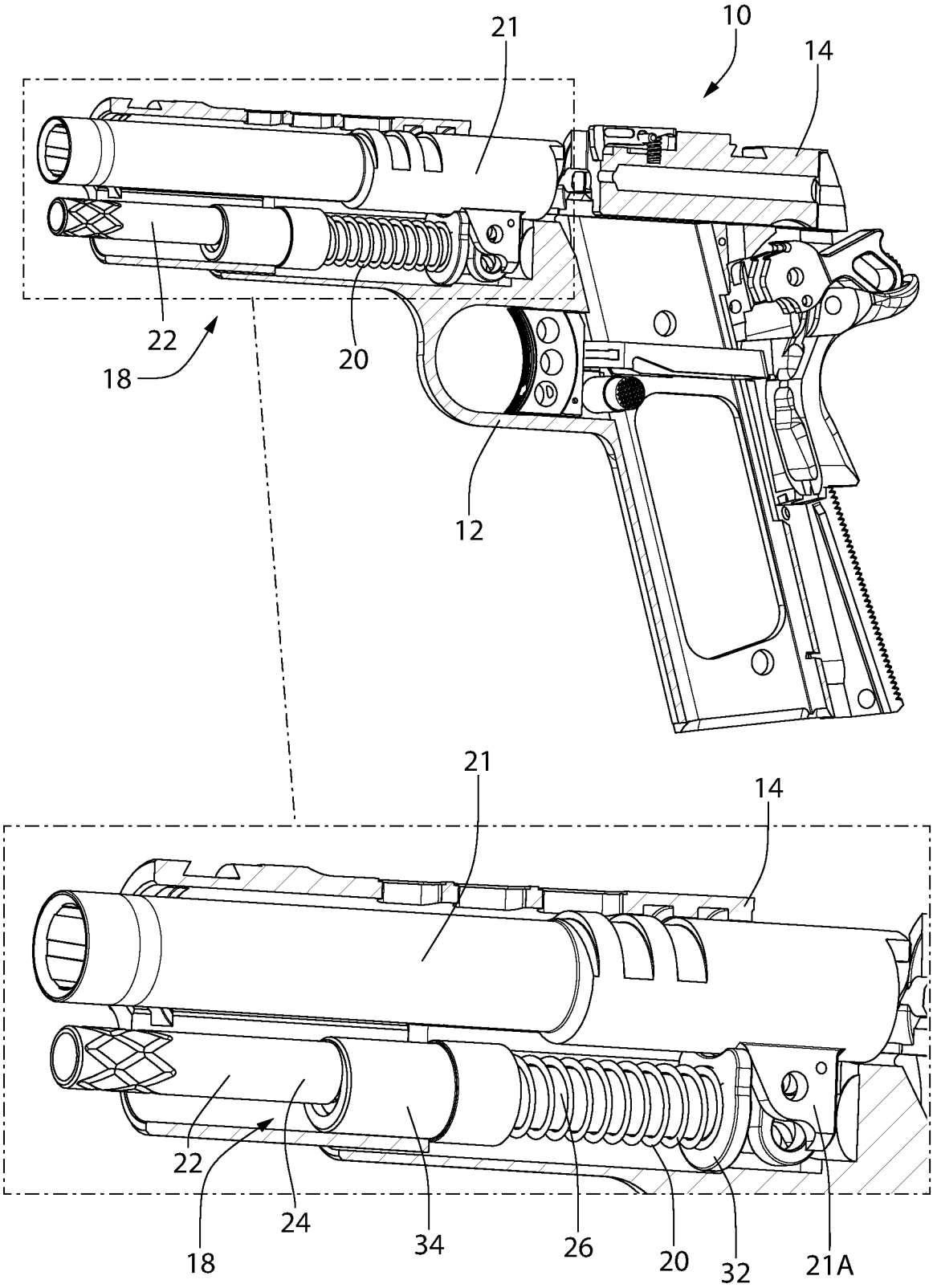
FIG. 10F is a cross-sectional view of the pistol of FIG. 1, shown with a portion enlarged, and shown in a position of an assembled pistol with the slide in a partially retracted position, wherein the front rod portion and the rear rod portion shown in full (i.e., not in cross-section), wherein force from the recoil spring assembly is between the barrel and the front rod portion.
Figure 10G:
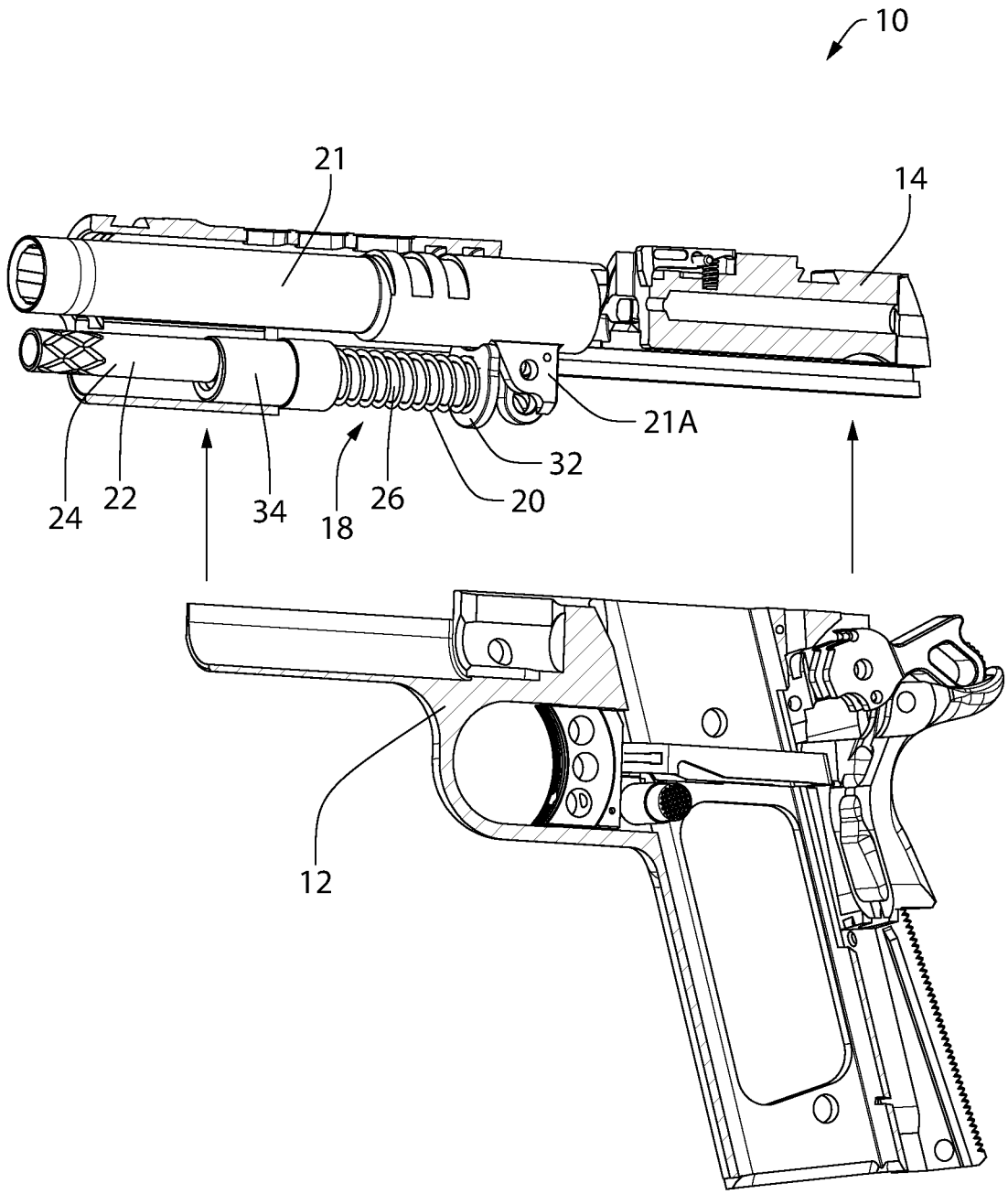
FIG. 10G is a cross-sectional view of the pistol of FIG. 1, with elements in the configuration of FIG. 10F, shown with the slide removed from the frame, wherein the recoil spring assembly is removable from the slide due to no spring load on the barrel.

Another feature of the recoil rod assembly 22 may be a detent assembly that provides a positive force to hold the front rod portion 24 with respect to the second rod portion 26 in the first position (FIGS. 9A, 9B) and/or the second (FIG. 9C). The detent assembly may include a plunger 44 urged by a detent spring 46 (or other biasing means) disposed in an aperture in the rear rod portion 26 that engages a shallow depression 48 at the front of the cylindrical protuberance 28 of the front rod portion 24. The detent assembly provides a tactile feel when the front rod portion 24 rotates back and forth relative to the rear rod portion 26 between the first position and the second position. An additional feature of the detent assembly may be a press feature to initiate turning of the front rod portion 24 with respect to the rear rod portion 26. This is accomplished by the shape of the groove 42 as it engages the pin 38. For example, as the front rod portion 24 is rotated with respect to the rear rod portion 26, the shape of the groove 42 causes the front rod to move under the force of the detent spring 46 to locking rotation to prevent accidental rotation of the front rod portion 24 with respect to the rear rod portion 26.

FIGS. 9D through 9G depict an alternate exemplary construction of a recoil rod assembly 22'. Again, the recoil rod assembly 22' includes a front rod portion 24' and a rear rod portion 26' similar to that of the recoil rod assembly 22 of the prior embodiment disclosed. For ease, elements that are similar to the first embodiment described above, are designated with a prime symbol adjacent to the reference number. For example, in this alternate embodiment, the recoil rod assembly 22' of the alternate embodiment is similar to the recoil rod assembly 22 of the first embodiment.

In this alternate embodiment, the detent feature of the recoil rod assembly 22' has a different configuration than that of the first embodiment. As can best be seen in FIGS. 9F and 9G, a spring 46' is disposed in an aperture 50 in the front rod portion 24'. The spring 46' abuts a surface 52 in the aperture 50 that biases the front rod portion 24' away from the rear rod portion 26'. A pin 38' sits is disposed in an aperture 40' in the rear rod portion 26' and secures the front rod portion 24' to the rear rod portion 26' via a groove 42' in the front rod portion 24'. As can be seen when comparing FIG. 9D to FIG. 9E, the groove has a flat portion to create a click-type detent. The groove 42' having the flat portion in combination with the pin 38' enables the recoil rod assembly 22' to lock in the open position (FIG. 9G) by the spring 46' pushing the front rod portion 24' forward. The pin 38' engages the flat to prevent rotation when open (and disengages when closed (FIG. 9F)), unless the front rod portion 24' is pushed backwards to the rear rod portion 26'. A cap 54 may be provided to cover the hollow internal front rod portion 24'. While he cap 54 improves the appearance of the recoil rod assembly 22', the hollow portion of the front rod portion 24' allows for a lighter rod such that the assembly better withstands G-Forces during recoil.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. A recoil rod assembly for a semi-automatic firearm, comprising:

(a) a front rod portion having a front end, a rear end, and a longitudinal axis;

(b) a rear rod portion having a front end, a rear end and a longitudinal axis, said rear rod portion having a substantially same cross-section as the front rod portion;

(c) a cylindrical protuberance having a longitudinal axis disposed at one of the rear end of the front rod portion and the front end of the rear rod portion;

(d) a cylindrical aperture having a longitudinal axis disposed at the other of the rear end of the front rod portion and the front end of the rear rod portion;

(e) wherein at least one of the longitudinal axis of the cylindrical protuberance and the longitudinal axis of the cylindrical aperture is offset from the longitudinal axis of the rear rod portion;

(f) a flange at the rear end of the rear rod portion to receive a recoil spring; and (g) wherein the cylindrical protuberance is disposed in the cylindrical aperture, wherein the longitudinal axis of the cylindrical protuberance and the longitudinal axis of the cylindrical aperture are coaxial; and (h) wherein the front rod portion is rotatable with respect to the rear rod portion about the coaxial longitudinal axes of the cylindrical protuberance and the cylindrical aperture from a first position wherein the longitudinal axis of the front rod portion is coaxial with the longitudinal axis of the rear rod portion to a second position wherein the longitudinal axis of the front rod portion is offset from the longitudinal axis of the rear rod portion, wherein a stepped surface on the rear end of the front rod is exposed.

2. The recoil rod assembly of claim 1, further comprising an aperture in one of the front rod portion and the rear rod portion to receive a pin, the pin disposed in a groove in the other of the front rod portion and the rear rod portion to prevent separation of the front rod portion from the rear rod portion.

3. The recoil rod assembly of claim 1, further comprising a detent assembly that provides a tactile feel when the front rod portion is rotated from the first position to the second position and when the front rod portion is rotated from the second position to the first position.

4. The recoil rod assembly of claim 3, wherein the detent assembly comprises a detent spring and a pin that mates with at least one corresponding depression in the protuberance.

5. The recoil rod assembly of claim 1, wherein the semi-automatic firearm is a 1911-style pistol.

6. A semi-automatic firearm comprising a frame and slide, the slide moveable from a retracted position whereby a recoil spring is fully compressed, to a closed position wherein the recoil spring is fully extended, the slide comprising a recoil spring assembly, the recoil spring assembly comprising:

(a) the recoil spring having a first end, a second end, and a longitudinal axis;

(b) a recoil rod assembly, comprising:

(i) a front rod portion having a front end, a rear end, and a longitudinal axis;

(ii) a rear rod portion having a front end, a rear end, and a longitudinal axis, said rear rod portion having a substantially same cross-section as the front rod portion;

(iii) a cylindrical protuberance having a longitudinal axis disposed at one of the rear end of the front rod portion and the front end of the rear rod portion;

(iv) a cylindrical aperture having a longitudinal axis disposed at the other of the rear end of the front rod portion and the front end of the rear rod portion;

(v) wherein at least one of the longitudinal axis of the cylindrical protuberance and the longitudinal axis of the cylindrical aperture is offset from the longitudinal axis of the rear rod portion;

(vi) a flange at the rear end of the rear rod portion to receive the first end of the recoil spring; and (vii) wherein the cylindrical protuberance is disposed in the cylindrical aperture, wherein the longitudinal axis of the cylindrical protuberance and the longitudinal axis of the cylindrical aperture are coaxial; and (c) a hollow recoil spring plug having a first end having an aperture to slidingly receive the front rod portion and the rear rod portion, and a second end open to receive the second end of the recoil spring, wherein the recoil spring is captured within the hollow plug at the first end of the recoil spring plug;

wherein the front rod portion is rotatable with respect to the rear rod portion about the coaxial longitudinal axes of the cylindrical protuberance and the cylindrical aperture from a first position wherein the longitudinal axis of the front rod portion is coaxial with the longitudinal axis of the rear rod portion to a second position wherein the longitudinal axis of the front rod portion is offset from the longitudinal axis of the rear rod portion, wherein a stepped surface on the rear end of the front rod is exposed;

wherein when the slide is in the closed position, the recoil spring is in a fully extended position in the firearm, the first end of the recoil spring plug is disposed at the front end of the front rod portion wherein the longitudinal axis of the front rod portion is coaxial with the longitudinal axis of the rear rod portion;

wherein when the slide is in the retracted position, the recoil spring is in a fully compressed position in the firearm, the recoil spring plug is disposed at the front end of the rear rod portion, whereby the front rod portion rotatable with respect to the rear rod portion;

wherein when the stepped surface is exposed and the slide is released from its fully retracted position, the stepped surface is captured by the first end of the recoil spring plug, wherein the recoil spring is captured between the recoil spring plug and the flange;

whereby, when the slide is removed from the frame, removal of the recoil spring assembly is facilitated without the use of a tool.

7. The semi-automatic firearm of claim 6, wherein the recoil rod assembly further includes an aperture in one of the front rod portion and the rear rod portion to receive a pin, the pin disposed in a groove in the other of the front rod portion and the rear rod portion to prevent separation of the front rod portion from the rear rod portion.

8. The semi-automatic firearm of claim 6, wherein the recoil rod assembly includes a detent assembly that provides a tactile feel when the front rod portion is rotated from the first position to the second position and when the front rod portion is rotated from the second position to the first position.

9. The semi-automatic firearm of claim 8, wherein the detent assembly includes a detent spring and a pin that mates with at least one corresponding depression in the protuberance.

10. The semi-automatic firearm of claim 6, wherein the firearm is a 1911-style pistol.

11. A semi-automatic firearm comprising a frame and slide, the slide moveable from a retracted position whereby a recoil spring is fully compressed, to a closed position wherein the recoil spring is fully extended, the slide comprising a recoil spring assembly, the recoil spring assembly comprising:

(a) the recoil spring having a first end, a second end, and a longitudinal axis;

(b) a recoil rod assembly, comprising:

(i) a front rod portion having a front end, a rear end, and a longitudinal axis;

(ii) a rear rod portion having a front end, a rear end, and a longitudinal axis, said rear rod portion having a substantially same cross-section as the front rod portion;

(iii) a flange at the rear end of the rear rod portion to receive the first end of the recoil spring;

(iv) wherein the front rod portion and the rear rod portion are rotatable about a longitudinal axis offset from the front rod longitudinal axis and the rear rod longitudinal axis;

(c) a hollow recoil spring plug having a first end having an aperture to slidingly receive the front rod portion and the rear rod portion, and a second end open to receive the second end of the recoil spring, wherein the recoil spring is captured within the hollow plug at the first end of the recoil spring plug;

wherein the front rod portion is rotatable with respect to the rear rod portion from a first position wherein the longitudinal axis of the front rod portion is coaxial with the longitudinal axis of the rear rod portion to a second position wherein the longitudinal axis of the front rod portion is offset from and parallel with the longitudinal axis of the rear rod portion, wherein a stepped surface on the rear end of the front rod is exposed;

wherein when the slide is in the closed position, the recoil spring is in a fully extended position in the firearm, the first end of the recoil spring plug is disposed at the front end of the front rod portion wherein the longitudinal axis of the front rod portion is coaxial with the longitudinal axis of the rear rod portion;

wherein when the slide is in the retracted position, the recoil spring is in a fully compressed position in the firearm, the recoil spring plug is disposed at the front end of the rear rod portion, whereby the front rod portion rotatable with respect to the rear rod portion;

wherein when the stepped surface is exposed and the slide is released from the fully retracted position, the stepped surface is captured by the first end of the recoil spring plug, wherein the recoil spring is captured between the recoil spring plug and the flange;

whereby, when the slide is removed from the frame, removal of the recoil spring assembly is facilitated without the use of a tool.

12. The firearm of claim 11, wherein the recoil rod assembly further comprises:

(a) a cylindrical protuberance having a longitudinal axis disposed at one of the rear end of the front rod portion and the front end of the rear rod portion;

(b) a cylindrical aperture having a longitudinal axis disposed at the other of the rear end of the front rod portion and the front end of the rear rod portion;

(c) wherein at least one of the longitudinal axis of the cylindrical protuberance and the longitudinal axis of the cylindrical aperture is offset from the longitudinal axis of the rear rod portion;

(d) wherein the cylindrical protuberance is disposed in the cylindrical aperture, wherein the longitudinal axis of the cylindrical protuberance and the longitudinal axis of the cylindrical aperture are coaxial.

13. The semi-automatic firearm of claim 11, wherein the recoil rod assembly further includes an aperture in one of the front rod portion and the rear rod portion to receive a pin, the pin disposed in a groove in the other of the front rod portion and the rear rod portion to prevent separation of the front rod portion from the rear rod portion.

14. The semi-automatic firearm of claim 11, wherein the recoil rod assembly includes a detent assembly that provides a tactile feel when the front rod portion is rotated from the first position to the second position and when the front rod portion is rotated from the second position to the first position.

15. The semi-automatic firearm of claim 14, wherein the detent assembly includes a detent spring and a pin that mates with at least one corresponding depression in the protuberance.

16. The semi-automatic firearm of claim 11, wherein the firearm is a 1911-style pistol.

* * * * *